US009969092B2

(12) United States Patent
Liao et al.

(10) Patent No.: US 9,969,092 B2
(45) Date of Patent: May 15, 2018

(54) CUTTING APPARATUS

(71) Applicants: Houhan Liao, Wenzhou (CN); Hesheng Co., Ltd., Taoyuan (TW)

(72) Inventors: Houhan Liao, Wenzhou (CN); Cheng-Hsiung Chou, Taipei (TW)

( * ) Notice: Subject to any disclaimer, the term of this patent is extended or adjusted under 35 U.S.C. 154(b) by 249 days.

(21) Appl. No.: 15/002,262

(22) Filed: Jan. 20, 2016

(65) Prior Publication Data

US 2017/0106545 A1 Apr. 20, 2017

(30) Foreign Application Priority Data

Oct. 19, 2015 (CN) ..... 2015 2 0807630 U

(51) Int. Cl.
*B26B 13/08* (2006.01)

(52) U.S. Cl.
CPC ..... *B26B 13/08* (2013.01)

(58) Field of Classification Search
CPC ..... B26B 13/08
USPC ..... 30/195, 233.5, 355
See application file for complete search history.

(56) References Cited

U.S. PATENT DOCUMENTS 5,107,591 A * 4/1992 Sato ..... B26B 13/24 30/195
6,385,851 B2 * 5/2002 Yeh ..... B26B 13/08 30/195
2017/0106545 A1 * 4/2017 Liao ..... B26B 13/08

FOREIGN PATENT DOCUMENTS

DE 40 00 927 A1 * 1/1991
GB 2 153 732 A * 8/1985
JP 2005-87256 * 4/2005
JP 2006-191940 * 7/2006
JP U3204892 * 6/2016
WO WO 2017/067425 A1 * 4/2017

* cited by examiner

*Primary Examiner* — Hwei C Payer
(74) *Attorney, Agent, or Firm* — Tsz Lung Yeung

(57) ABSTRACT

A cutting apparatus includes a first cutting member and a second cutting member. The first cutting member includes a first handle and a first cutting blade. The first cutting blade includes a first blade support, and a plurality of blade members spacedly and inwardly extended from the first blade support. Each of the blade members has an elongated first blade portion and a tip portion extended from the elongated first blade portion. Each of the tip portions has a first cutting edge, at least a first guiding surface, a second guiding surface and a guiding edge formed as a boundary between the first guiding to surface and the second guiding surface. A vertical height of the first guiding surface and the second guiding surface gradually decreases from the guiding edge. The second cutting member includes a second handle and a second cutting blade.

19 Claims, 6 Drawing Sheets

CUTTING APPARATUS

CROSS REFERENCE OF RELATED APPLICATION

This application claims priority of one foreign application which is filed in China: application number 201520807630.X and filing date Oct. 19, 2015. The contents of the specification are incorporated herein by reference.

BACKGROUND OF THE PRESENT INVENTION

Field of Invention

The present invention relates to a cutting apparatus, and more particularly to scissors with curved cutting edges which are capable of facilitating easy and convenient cutting of an object, such as hair.

Description of Related Arts

A conventional cutting apparatus such as a conventional hair cutting scissors usually comprises a first cutting member and a second cutting member pivotally connected to the first cutting member through a pivot. The first cutting member usually comprises a first handle, and a first cutting portion extended from the first handle. The first cutting portion usually has a plurality of cutting teeth transversely and spacedly extended from the first cutting portion at an orientation pointing toward the second cutting member. Each of the cutting teeth has a first cutting blade formed as a free sharp tip thereof.

On the other hand, the second cutting member usually comprises a second handle and a second cutting portion extended from the second handle. The second cutting portion has a second cutting edge longitudinally formed along an inner side edge of the second cutting portion of the second cutting member. When an object such as hair is desired to be cut, the object should be placed at a position between the first cutting portion and the second cutting portion. The first cutting member and the second cutting member are then pivotally moved toward each other for cutting the object by the corresponding first cutting blade and the second cutting blade.

The conventional cutting apparatus described above has a disadvantage in that both of the first cutting blade and the second cutting blade are generally flat in structure. As a result, when the first cutting blade and the second cutting blade are pivotally moved to cut the object such as hair, the hair may not be properly severed and the cutting apparatus may accidentally pull the hair to be trapped in the space formed between the first cutting blade and the second cutting blade. This may cause uncomfortable feeling on the person to which the hair belong.

As a result, there is a need for a cutting apparatus which is capable of facilitating easy and convenient cutting of an object, such as hair.

SUMMARY OF THE PRESENT INVENTION

Certain variations of the present invention provide a cutting apparatus which is capable of facilitating easy and convenient cutting of an object, such as hair.

Certain variations of the present invention provide a cutting apparatus which comprises a first cutting blade and a second cutting blade, wherein the first cutting blade has at least a first cutting edge, a first guiding surface and a second guiding surface for guiding an object to be fully and effectively severed when the first cutting blade and the second cutting blade are pivotally moved to cut that object.

In one aspect of the present invention, it provides a cutting apparatus, comprising:

a first cutting member, which comprises:

a first handle; and a first cutting blade comprising a first blade support and a plurality of blade members spacedly and inwardly extended from the first blade support, each of the blade members having an elongated first blade portion and a tip portion extended from the elongated first blade portion, each of the tip portions having a first cutting edge, at least a first guiding surface, a second guiding surface and a guiding edge formed as a boundary between the first guiding surface and the second guiding surface, a vertical height of the first basing surface and the second guiding surface gradually decreasing from the guiding edge; and a second cutting member pivotally connecting to the first cutting member, and comprising:

a second handle; and a second cutting blade comprising a second blade portion having a second cutting edge longitudinally extended along the second cutting blade, wherein when the first cutting member and the second cutting member pivotally moves toward each other for cutting an object, the object is biased by the second guiding surface for allowing easy cutting of the object by the first cutting edge and the second cutting edge.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

Figure 1:
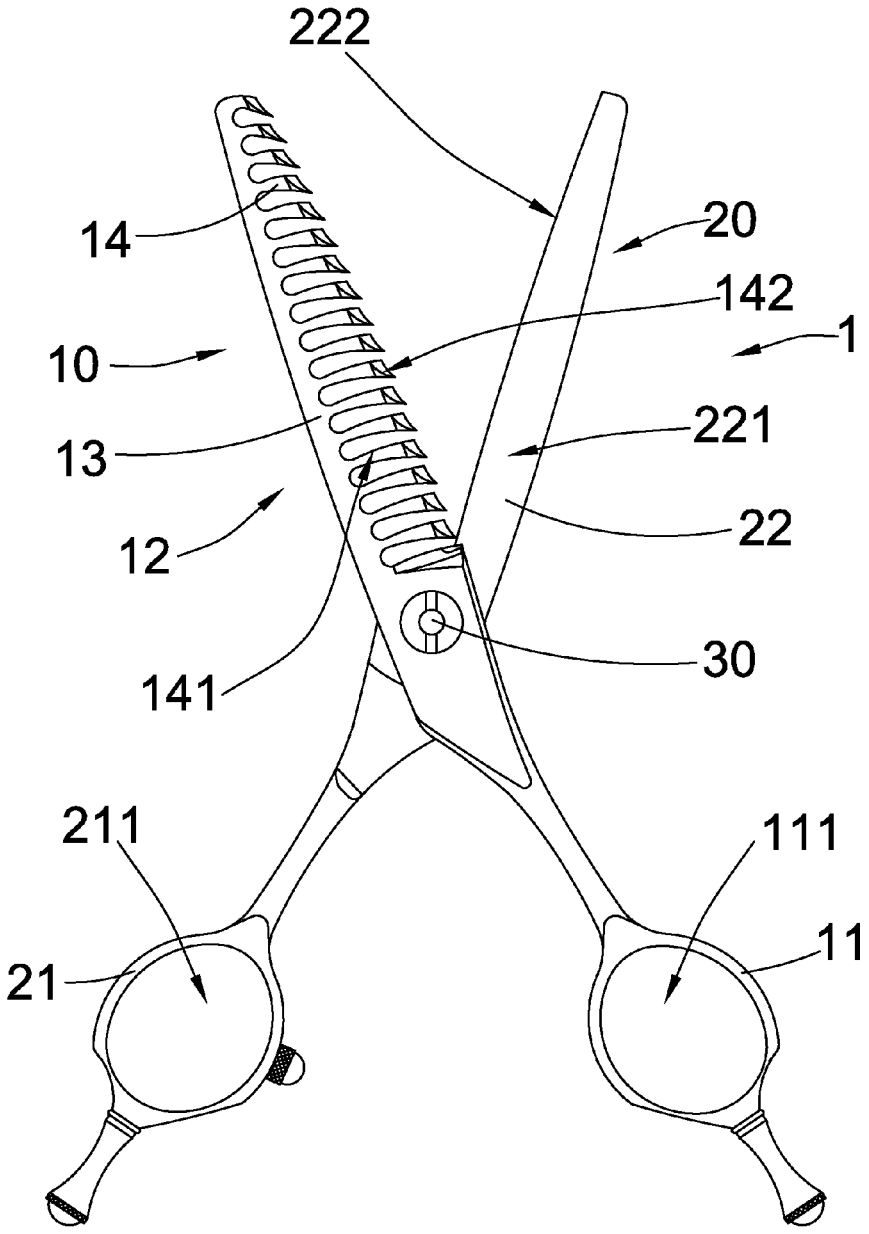
FIG. 1 is a top view of a cutting apparatus according to a preferred embodiment of the present invention.
Figure 2:
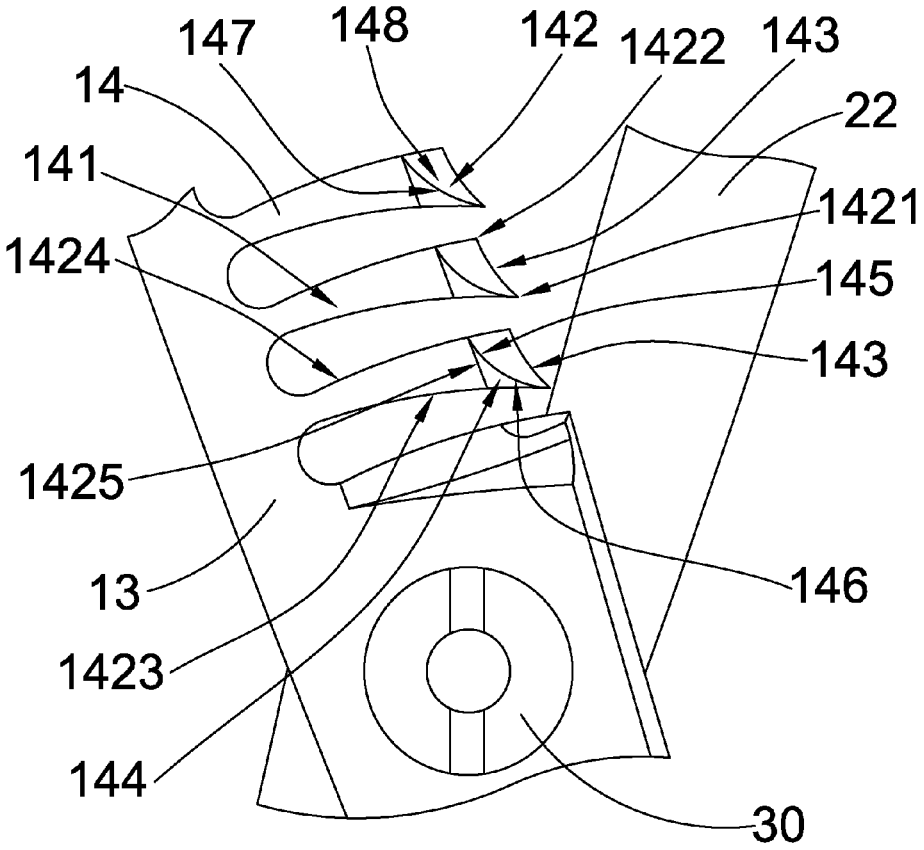
FIG. 2 is a schematic diagram of the cutting apparatus according to the preferred embodiment of the present invention.
Figure 3:
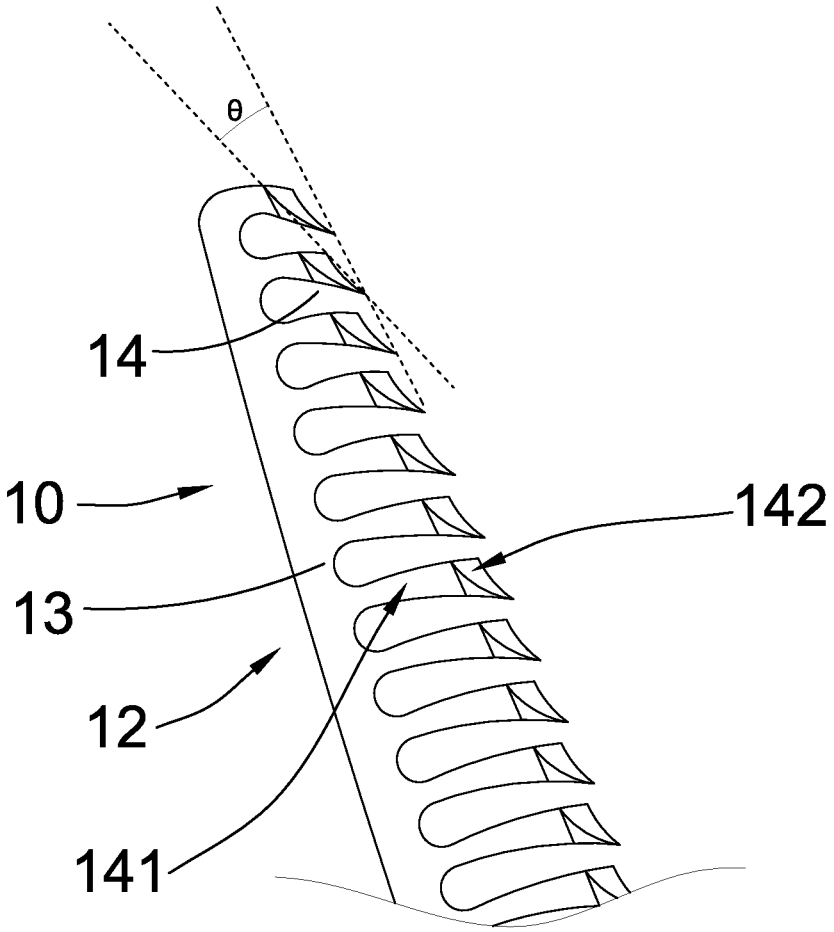
FIG. 3 is a schematic diagram of the cutting apparatus according to the preferred embodiment of the present invention, illustrating the angle of inclination between a first reference line and a second reference line.

Referring to FIG. 1 to FIG. 3 of the drawings, a cutting apparatus 1 cutting an object such as hair according to a preferred embodiment of the present invention is illustrated. Broadly, the cutting apparatus 1 may comprise a first cutting member 10 and a second cutting member 20. The cutting apparatus 1 may be configured as scissors for cutting an object such as hair.

The first cutting member 10 may comprise a first handle 11 and a first cutting blade 12. The first cutting blade 12 may comprise a first blade support 13 and a plurality of blade members 14 spacedly and inwardly extended from the first blade support 13. Each of the blade members 14 may have an elongated first blade portion 141 and a tip portion 142 extended from the elongated first blade portion 141. Each of the tip portions 142 may have a first cutting edge 143, at least a first guiding surface 144, a second guiding surface 145 and a guiding edge 146 formed as a boundary between the first guiding surface 144 and the second guiding surface 145. A vertical height of the first guiding surface 144 and the second guiding surface 145 may be gradually decreasing from the guiding edge 146.

The second cutting member 20 may be pivotally connected to the first cutting member 10, and comprise a second handle 21 and a second cutting blade 22. The second cutting blade 22 may comprise a second blade portion 221 having a second cutting edge 222 longitudinally extended along the second cutting blade 22. When the first cutting member 10 and the second cutting member 20 pivotally moves toward each other for cutting the object such as hair, the object may be biased by the second guiding surface 145 for allowing easy cutting of the object by the first cutting edge 143 and the second cutting edge 222. The chance of the object being trapped in the space between the first cutting member 10 and the second cutting member 20 may be minimized so as to overcome the shortcomings described with respect to the conventional cutting apparatus. As shown in FIG. 1 of the drawings, the first cutting member 10 is overlappedly connected to the second cutting member 20 when viewed from the top.

According to the preferred embodiment of the present invention, the cutting apparatus 1 may further comprise a pivot 30 pivotally connecting the first cutting member 10 to the second cutting member 20. As shown in FIG. 1 of the drawings, the pivot 30 may be connected to each of the first cutting member 10 and the second cutting member 20 at a position between the first handle 11 and the first cutting blade 12, and between the second handle 21 and the second cutting blade 22. As such, a user may be able to pivotally move the first handle 11 and the second handle 21 for pivotally moving the first cutting blade 12 and the second cutting blade 22. For the sake of clarity, the first cutting blade 12 may be defined as frontwardly extending from the first handle 11, while the second cutting blade 22 may be defined as frontwardly extending from the second handle 21.

The first handle 11 may have a first handle opening 111 while the second handle 21 may have a second handle opening 211. A user may use his two fingers to pass through the first handle opening 111 and the second handle opening 211 respectively to selectively drive the first cutting blade 12 and the second cutting blade 22 to pivotally move toward or apart from each other. A layer of soft or resilient material may be attached on the first handle 11 and the second handle 21 for providing cushioning effect to the user when he is operating the cutting apparatus 1 of the present invention.

The first cutting blade 12 of the first cutting member 10 may have an elongated structure and may have a length which corresponds to that of the second cutting blade 22. In this preferred embodiment, the first blade support 13 and the blade members 14 may be made of the same material and may form an integral structure. That means the blade members 14 are integrally, spacedly and inwardly extended from the first blade support 13 toward the second cutting blade 22.

Each of the tip portions 142 is extended from the corresponding elongated first blade portion 141 and may have a first sharp corner 1421 and a second sharp corner 1422, wherein the first cutting edge 143 may extend between the first sharp corner 1421 and the second sharp corner 1422. In this preferred embodiment, the first cutting edge 143 may be concavely curved from the first sharp corner 1421 to the second sharp corner 1422. The actual curvature of the first cutting edge 143 may be determined by the circumstances in which the cutting apparatus 1 is manufactured or utilized. Moreover, the first sharp corner 1421 may be positioned further away from the first blade support 13 than that of the second sharp corner 1422. Moreover, the first sharp corner 1421 may be positioned above the second sharp corner 1422 when the first cutting blade 11 rests on a flat surface.

Each of the tip portions 142 may be divided into a first cutting section 147 and a second cutting section 148, wherein the first guiding surface 144 and the second guiding surface 145 are formed on the first cutting section 147 and the second cutting section 148 respectively. The first cutting section 147 and the second cutting section 148 may be demarcated by the guiding edge 146. Each of the first guiding surface 144 and the second guiding surface 145 may have a curved or inclined contour for biasing against the object (such as hair) when it is being cut by the cutting apparatus. Moreover, each of the first guiding surface 144 and the second guiding surface 145 may inclinedly extend from the guiding edge 146 toward the first cutting edge 143.

As shown in FIG. 2 of the drawings, the tip portion 142 may have a first side edge 1423 extended from the first sharp corner 1421, a second side edge 1424 extended from the second sharp corner 1422, and an inner boundary 1425 transversely extended between inner ends of the first side edge 1423 and the second side edge 1424. The guiding edge 146 may extend along a diagonal of the corresponding tip portion 142, with the first guiding surface 144 formed between the guiding edge 146, the first side edge 1423, and the inner boundary 1425 of the tip portion 142. On the other hand, the second guiding surface 145 may be formed between the guiding edge 146, the second side edge 1424, and the first cutting edge 143.

Furthermore, each of the tip portions 142 may have varying vertical thickness along the first guiding surface 144 and the second guiding surface 145. In other words, each of the first cutting sections 147 and the second cutting sections 148 may have varying thickness at different points thereof. In this preferred embodiment of the present invention, the guiding edge 146 may extend from a point where the first cutting section 147 has its minimum thickness to a point where the second cutting section 148 has its maximum thickness.

A thickness of each of the elongated first blade portions 141 may gradually decrease from the first blade support 13 toward the corresponding tip portion 142. Each of the elongated first blade portions 141 may have a curved cross sectional contour. The exact curvature of the elongated first blade portions 141 may be determined by the circumstances in which the cutting apparatus 1 is manufactured or utilized.

When the cutting apparatus 1 is being operated to cut the object such as hair, the hair may first be positioned between the first cutting blade 12 and the second cutting blade 22. When the first cutting blade 12 and the second cutting blade 22 are pivotally moved toward each other to cut the object, the object may be guided by the first cutting edge 143 and the second guiding surface 145 to slightly rotate and to become stiffer. The object will then be conveniently and easily cut by the first cutting blade 12 and the second cutting blade 22.

In this preferred embodiment of the present invention, the tip portion 142 is configured such that an angle of inclination between a first reference line and a second reference line may be approximately 20° to approximately 45° . Referring to FIG. 3 of the drawings, the first reference line may be hypothetically formed by joining two adjacent first sharp corners 1421 of the blade members of the first cutting blade 12. The second reference line may be hypothetically formed by joining the first sharp corner 1421 and the second sharp corner 1422 for the corresponding tip portion 142. The preferred angle θ of inclination is approximately 24.5°.

Figure 4:
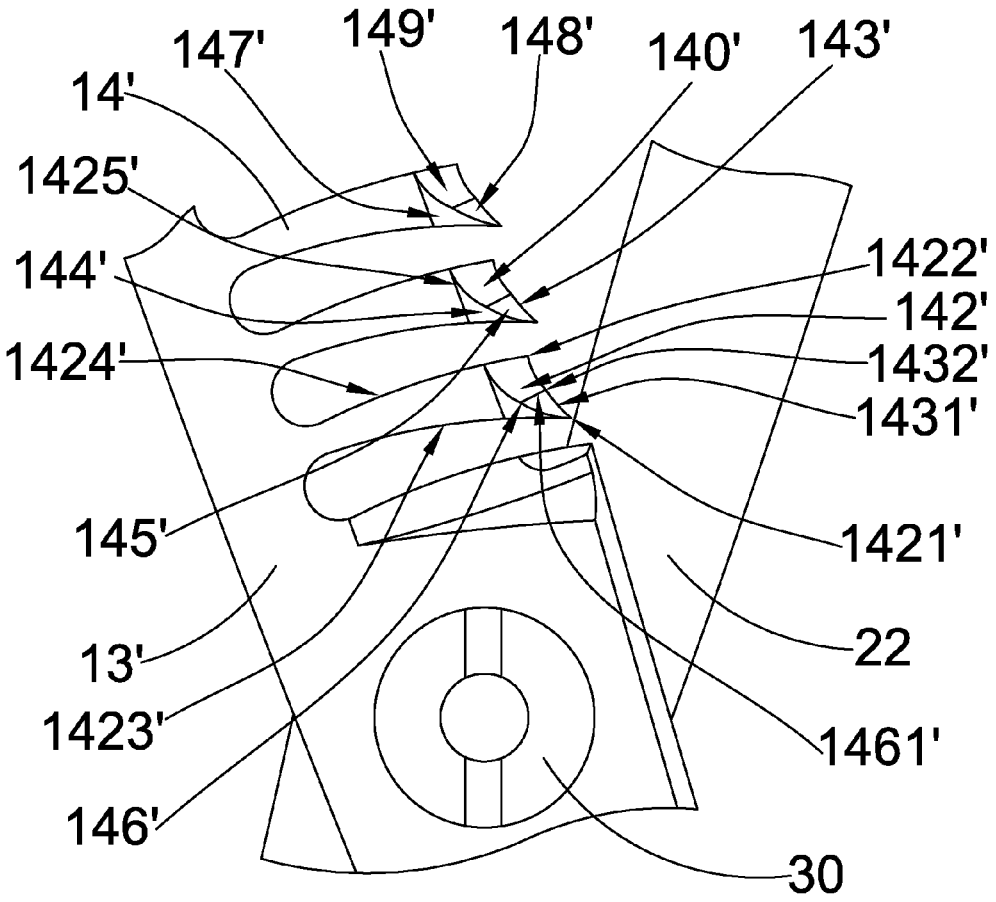
FIG. 4 is a schematic diagram of a first alternative mode of the cutting apparatus according to the preferred embodiment of the present invention.

Referring to FIG. 4 of the drawings, a first alternative mode of the cutting apparatus 1 according to the preferred embodiment of the present invention is illustrated. The first alternative mode is similar to the preferred embodiment, except the tip portion 142' of the blade member 14'. According to the first alternative mode, each of the tip portions 142' may have a first cutting edge 143', a first guiding surface 144', a second guiding surface 145' and a guiding edge 146' formed as a boundary between the first guiding surface 144' and the second guiding surface 145' and the third guiding surface 140'. Each of the tip portions 142' may have a first sharp corner 1421', a second sharp corner 1422'.

Moreover, each of the tip portions 142' may be divided into a first cutting section 147', a second cutting section 148' and a third cutting section 149', wherein the first guiding surface 144', the second guiding surface 145' and the third guiding surface 140' are formed on the first cutting section 147', the second cutting section 148' and the third cutting section 149' respectively.

The first guiding surface 144' and the second guiding surface 145' may be demarcated by the guiding edge 146'. Each of the first guiding surface 144' and the second guiding surface 145' may have a curved or inclined contour for biasing against the object (such as hair) when it is being cut by the cutting apparatus 1. Moreover, each of the first guiding surface 144' and the second guiding surface 145' may inclinedly extend from the guiding edge 146' toward the first cutting edge 143'. The first cutting edge 143' extends between the first sharp corner 1421' and the second sharp corner 1422'.

The first cutting edge 143' may be concavely curved from the first sharp corner 1421' to the second sharp corner 1422'. Moreover, the first sharp corner 1421' may be positioned further away from the first blade support 13' than that of the second sharp corner 1422'. The first sharp corner 1421' may be positioned above the second sharp corner 1422' when the first cutting blade 12 rests on a flat surface.

As described in the preferred embodiment of the present invention, the tip portion 142' may have a first side edge 1423' extended from the first sharp corner 1421', a second side edge 1424' extended from the second sharp corner 1422', and an inner boundary 1425' transversely extended between the first side edge 1423' and the second side edge 1424'. The guiding edge 146' may extend along a diagonal of the corresponding tip portion 142', with the first guiding surface 144' being formed between the guiding edge 146', the first side edge 1423', and the inner boundary 1425' of the tip portion 142'.

Each of the tip portions 142' may further has an additional guiding edge 1461' which may extend from the guiding edge 146' and may be configured to demarcate the second guiding surface 145' and the third guiding surface 140'. As shown in FIG. 4 of the drawings, the additional guiding edge 1461' may extend between the guiding edge 146' and the first cutting edge 143' to divide the first cutting edge 143' into a first edge section 1431' and a second edge section 1432'. Specifically, the second guiding surface 145' may be formed between the guiding edge 146', the first edge section 1431' of the first cutting edge 143', and the additional guiding edge 1461'. The third guiding surface 140' may be formed between the guiding edge 146', the additional guiding edge 1461', the second edge section 1432' of the first cutting edge 143' and the second side edge 1424'. Thus, the third guiding surface 140' may have a quadrilateral cross section when viewed from the top.

Each of the tip portions 142' may have varying vertical thickness along the first guiding surface 144', the second guiding surface 145' and the third guiding surface 140'. Each of the first cutting section 147', the second cutting section 148' and the third cutting section 149' may have varying thickness at different points thereof. In this preferred embodiment of the present invention, the guiding edge 146' may extend from a point where the first cutting section 147' has its minimum thickness to the points where the second cutting section 148' and the third cutting section 149' have their maximum thickness.

Figure 5:
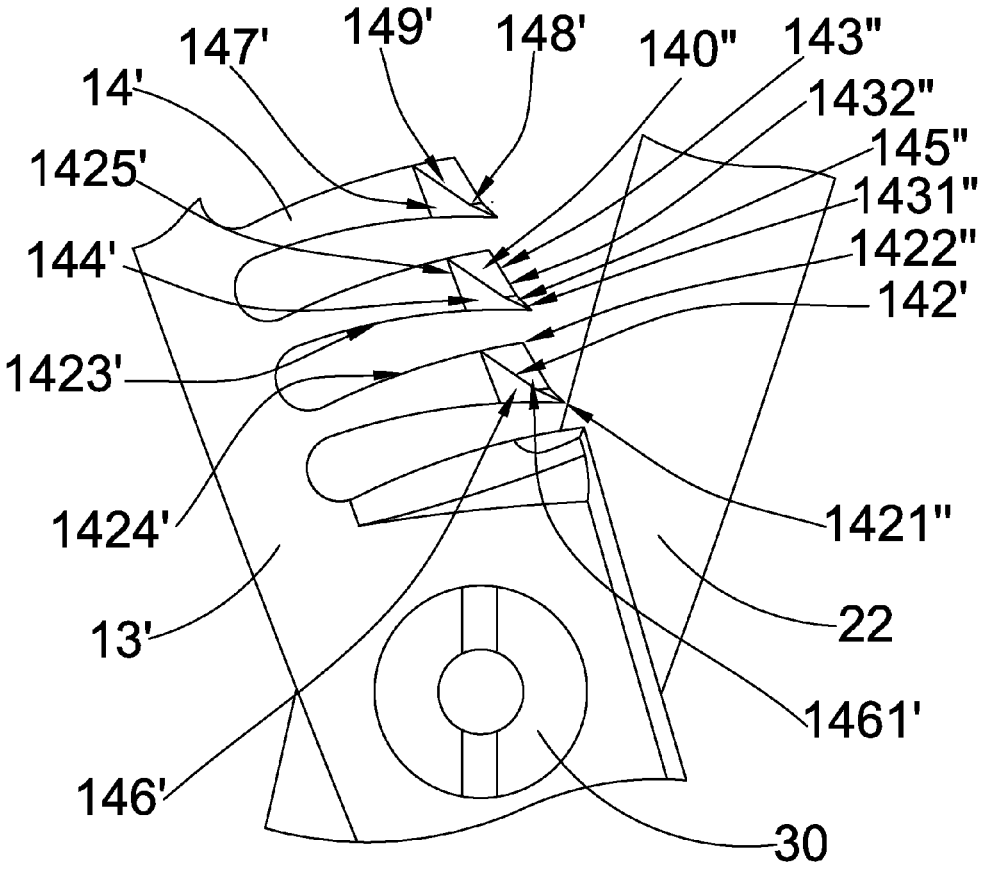
FIG. 5 is a schematic diagram of a second alternative mode of the cutting apparatus according to the preferred embodiment of the present invention.
Figure 6:
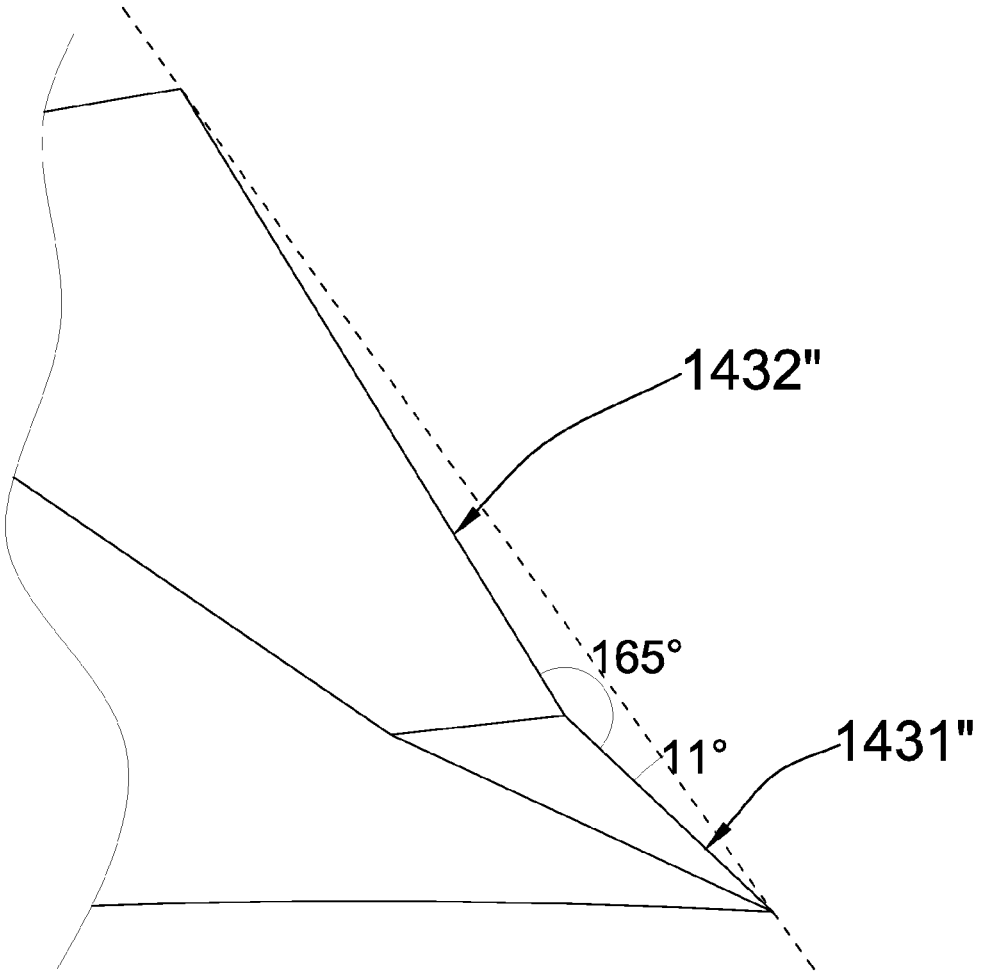
FIG. 6 is a schematic diagram of the tip portion of the cutting apparatus according to a second alternative mode of the preferred embodiment of the present invention.

Referring to FIG. 5 and FIG. 6 of the drawings, a cutting apparatus 1 according to a second alternative mode of the preferred embodiment of the present invention is illustrated. The second alternative mode is similar to the first alternative mode described above, except the second guiding surface 145" and the third guiding surface 140". In this second alternative mode, the second guiding surface 145" and the third guiding surface 140" may not align with each other and form a predetermined angle of inclination. Specifically, the second guiding surface 145" may have a steeper slope than that of the third guiding surface 140" with respect to the horizontal.

Furthermore, the first edge section 1431" and the second edge section 1432" may form a predetermined angle of inclination which is preferably to be approximately 165°. In addition, when a hypothetical line is drawn to join the first sharp corner 1421" and the second sharp corner 1422", and angle of inclination between this hypothetical line and the first edge section 1431" is approximately 11°.

The present invention, while illustrated and described in terms of a preferred embodiment and several alternatives, is not limited to the particular description contained in this specification. Additional alternative or equivalent components could also be used to practice the present invention.

What is claimed is:

1. A cutting apparatus, comprising:

a first cutting member, which comprises:

a first handle; and a first cutting blade comprising a first blade support and a plurality of blade members spacedly and inwardly extended from said first blade support, each of said blade members having an elongated first blade portion and a tip portion extended from said elongated first blade portion, each of said tip portions having a first cutting edge, at least a first guiding surface, a second guiding surface and a guiding edge formed as a boundary between said first guiding surface and said second guiding surface, a vertical height of said first guiding surface and said second guiding surface gradually decreasing from said guiding edge, wherein each of said tip portions is extended from said corresponding first blade portion, and has a first sharp corner and a second sharp corner, said first cutting edge extending between said first sharp corner and said second sharp corner, said first cutting edge being concavely curved from said first sharp corner to said second sharp corner; and a second cutting member pivotally connecting to said first cutting member, and comprising:

a second handle; and a second cutting blade comprising a second blade portion having a second cutting edge longitudinally extended along said second cutting blade, wherein when said first cutting member and said second cutting member pivotally moves toward each other for cutting an object, said object is biased by said second guiding surface for allowing easy cutting of said object by said first cutting edge and said second cutting edge.

2. The cutting apparatus, as recited in claim 1, wherein said first sharp corner being positioned further away from said first blade support than that of said second sharp corner, said first sharp corner being positioned above said second sharp corner when said first cutting blade rests on a flat surface.

3. The cutting apparatus, as recited in claim 2, wherein each of said tip portions being divided into a first cutting section and a second cutting section, wherein said first guiding surface and said second guiding surface are formed on said first cutting section and said second cutting section respectively, said first cutting section and said second cutting section are demarcated by said guiding edge, each of said first guiding surface and said second guiding surface inclinedly extending from said guiding edge toward said first cutting edge.

4. The cutting apparatus, as recited in claim 3, wherein each of said tip portions has a first side edge extended from said first sharp corner, a second side edge extended from said second sharp corner, and an inner boundary transversely extended between inner ends of said first side edge and said second side edge, said guiding edge extending along a diagonal of said corresponding tip portion, said first guiding surface being formed between said guiding edge, said first side edge, and said inner boundary of said tip portion, said second guiding surface being formed between said guiding edge, said second side edge, and said first cutting edge.

5. The cutting apparatus, as recited in claim 4, wherein each of said tip portions has non-uniform vertical thickness along said first guiding surface and said second guiding surface, said guiding edge extending from a point where said first cutting section has the minimum thickness to a point where said second cutting section has the maximum thickness.

6. The cutting apparatus, as recited in claim 5, wherein a thickness of each of said elongated first blade portions gradually decreases from said first blade support toward said corresponding tip portion, each of said elongated first blade portions having a curved cross sectional contour.

7. The cutting apparatus, as recited in claim 6, wherein said tip portion being configured such that an angle of inclination between a hypothetical first reference line and a hypothetical second reference line is approximately 20° to approximately 45°, said first reference line being formed by joining two adjacent first sharp corners of said blade members, said second reference being formed by joining said first sharp corner and said second sharp corner for one of said corresponding tip portion.

8. The cutting apparatus, as recited in claim 7, wherein said angle of inclination between said hypothetical first reference line and said hypothetical second reference line is approximately 24.5°.

9. The cutting apparatus, as recited in claim 1, wherein said tip portion being configured such that an angle of inclination between a hypothetical first reference line and a hypothetical second reference line is approximately 20° to approximately 45°, said first reference line being formed by joining two adjacent first sharp corners of said corresponding blade members, said second reference being formed by joining said first sharp corner and said second sharp corner for said corresponding tip portion.

10. The cutting apparatus, as recited in claim 9, wherein said angle of inclination between said hypothetical first reference line and said hypothetical second reference line is approximately 24.5°.

11. The cutting apparatus, as recited in claim 2, wherein each of said tip portions further has a third guiding surface, said guiding edge being formed as a boundary between said first guiding surface, and said second guiding surface and said third guiding surface, each of said tip portions having a first sharp corner and a second sharp corner, said first cutting edge extending from said first sharp corner to said second sharp corner.

12. The cutting apparatus, as recited in claim 11, wherein each of said tip portions being divided into a first cutting section, a second cutting section and a third cutting section, wherein said first guiding surface, said second guiding surface and said third guiding surface are formed on said first cutting section, said second cutting section and said third cutting section respectively.

13. The cutting apparatus, as recited in claim 12, wherein said first guiding surface and said second guiding surface being demarcated by said guiding edge, each of said first guiding surface and said second guiding surface inclinedly extending from said guiding edge toward said first cutting edge.

14. The cutting apparatus, as recited in claim 13, wherein each of said tip portions further has an additional guiding edge extending from said guiding edge to demarcate said second guiding surface and said third guiding surface, and to divide said first cutting edge into a first edge section and a second edge section, said second guiding surface being formed between said guiding edge, said first edge section of said first cutting edge, and said additional guiding edge, said third guiding surface being formed between said guiding edge, said additional guiding edge, said second edge section of said first cutting edge and said second side edge.

15. The cutting apparatus, as recited in claim 14, wherein said guiding edge extends from a point where said first cutting section has the minimum thickness to points where said second cutting section and said third cutting section have the maximum thickness.

16. The cutting apparatus, as recited in claim 15, wherein said second guiding surface and said third guiding surface form a predetermined angle of inclination, said second guiding surface having a greater slope than that of said third guiding surface with respect to horizontal.

17. The cutting apparatus, as recited in claim 16, wherein said first edge section and said second edge section form a predetermined angle of inclination which is approximately 165°.

18. The cutting apparatus, as recited in claim 17, wherein an angle of inclination between a hypothetical line joining said first sharp corner and said second sharp corner, and said first edge section is approximately 11°.

19. The cutting apparatus, as recited in claim 16, wherein an angle of inclination between a hypothetical line joining said first sharp corner and said second sharp corner, and said first edge section is approximately 11°.

* * * * *